US005259164A

United States Patent [19]

Wiese

[11] Patent Number: 5,259,164

[45] Date of Patent: Nov. 9, 1993

[54] WALL CONSTRUCTED WITH A PLURALITY OF DETACHABLE BOARDS CONNECTED WITH ONE ANOTHER

[76] Inventor: Martin Wiese, Im Wiesengrund 14, 6977 Werbach-Brunntal, Fed. Rep. of Germany

[21] Appl. No.: 955,370

[22] Filed: Oct. 1, 1992

[30] Foreign Application Priority Data

Oct. 1, 1991 [DE] Fed. Rep. of Germany ..... 4132674

[51] Int. Cl.[5] ..... E04C 3/30

[52] U.S. Cl. ..... 52/586; 160/135; 52/578

[58] Field of Search ..... 160/135; 52/578, 582, 52/585, 586, 238.1, 239, 241, 69, 71; 403/4, 157, 161, 295; 16/378, 366

[56] References Cited

U.S. PATENT DOCUMENTS

| | | | |
|---|---|---|---|
| 2,790,258 | 4/1957 | Freshour | 160/135 X |
| 3,677,322 | 7/1972 | Brorson et al. | 52/71 X |
| 3,766,692 | 10/1973 | Stark et al. | 52/71 |
| 3,766,959 | 10/1973 | Himsl | 160/135 |
| 3,990,204 | 11/1976 | Haworth et al. | 52/239 |
| 4,424,654 | 1/1984 | Anderson et al. | 52/239 |
| 4,601,145 | 7/1986 | Wilcox | 160/135 X |
| 4,756,053 | 7/1988 | Madden et al. | 16/378 X |
| 4,761,922 | 8/1988 | Black | 160/135 X |
| 4,860,812 | 8/1989 | DePietro et al. | 160/135 |
| 4,977,696 | 12/1990 | Johansson | 160/135 X |

FOREIGN PATENT DOCUMENTS 8703321 6/1987 World Int. Prop. O. ..... 52/239

*Primary Examiner*—Peter M. Cuomo
*Assistant Examiner*—Jerry Redman
*Attorney, Agent, or Firm*—Edwin D. Schindler

[57] ABSTRACT

A wall capable of rapid assembly and dismantling is disclosed, which includes a plurality of detachable boards, each of which are connected to at least one other of such detachable boards on an adjacent facing side. Coupling elements for connecting each of the plurality of detachable boards to another of such board are included, each of which permit at least a part of the facing sides of the plurality of detachable boards, which extend in a vertical direction, an infinitely variable swiveling action about an axis extending parallel to the facing sides of the plurality of detachable boards. The coupling elements extend perpendicularly to a swiveling axis and in the direction of the swiveling axis and are fastened edgeways laying flat to each of two detachable boards which are adjacent one another. The coupling elements act as a spacing piece along the facing side of each of the detachable boards and extend perpendicular to the swiveling axis. Preferably, the coupling elements are a plurality of hinges being attached to the detachable boards with fastening elements, with each of the hinges having two legs which are movable about an axis defining the swiveling axis of the detachable boards. The plurality of hinges are made detachable, but are otherwise rigidly fixed to an edge of each of two detachable boards.

19 Claims, 2 Drawing Sheets

WALL CONSTRUCTED WITH A PLURALITY OF DETACHABLE BOARDS CONNECTED WITH ONE ANOTHER

BACKGROUND OF THE INVENTION

1. Technical Field of the Invention

The present invention relates to the construction of a wall, especially a wall of the type useful for trade fairs and exhibition construction, having a plurality of detachable boards connected with one another.

More particularly, the present invention concerns a wall constructed of detachable boards which are connected with one another on adjacent facing sides via coupling elements which permit, at least one part of the facing sides extending in a vertical direction, an infinitely variable swiveling action about an axis extending parallel to the facing sides of the wall. The coupling elements for the invention extend perpendicular to the swiveling axis and, in the direction of the swiveling axis, are fastened edgeways lying flat to each of the two boards so coupled. The coupling elements of the invention represent a spacer along the facing side of the board extending perpendicular to the swiveling axis.

2. Description of the Prior Art

It is generally known to the relevant technical art to produce larger wall surfaces of boards arranged adjacently, or over one another, by connecting them to one another via coupling elements. For the requirements of a trade fair-and exhibition-type of construction, the potential for a rapid assembly and dismantling is a leading consideration, so that coupling elements are to be used which allow separation and renewed reconnection in a minimum of assembly time.

In situations involving change of floor plan after erection or disassembly of the wall, to create seating or sales corners, and for the optical subdivision of larger walls, it is especially important, in the case of walls which are to be repeatedly used and which must be adjusted to varying conditions, to fashion the connection of at least some of the boards among one another so that they can swivel about an axis which extends, principally, in a vertical direction. To this end, the use of plug-in connections as coupling elements is known to the art. Such plug-in connections are rigid and have, extending in two directions from a plane, pegs that are disposed perpendicularly to the swiveling axis and engage edgeways with the boards, whereby the pegs define the swiveling axis of the board which extends into their interior.

After the coupling element has been connected in the same way with the adjacent board, two swiveling axes, relatively close and extending parallel to one another, stand between the two boards, which may be swiveled relative to one another in an infinitely variable manner. This fact is to be seen as a decisive disadvantage, as two rotational axes hardly permit an exact alignment of the boards and, furthermore, between the individual boards, an air gap is formed which allows for movement of the board edges. This is particularly true when angles of traverse of less than 90° are of concern. Additionally, such construction is aesthetically disadvantageous. Finally, a change in the connection angle frequently results in an alteration of the center distance.

SUMMARY OF THE INVENTION

It is, therefore, an object of the present invention to provide an improved construction for walls which are constructed of boards and which can rapidly be erected and dismantled and which allow for variable angle adjustment, at least in the range of 90° to 270°, while retaining axis dimension from rotational axis to rotational axis.

The foregoing and related objects are achieved in accordance with the present invention in which the coupling elements for adjacent wall boards is a hinge, the two sections, or legs, of which are movable about an axis defining the swiveling axis of the boards and are detachable via fastening means, but which are, nevertheless, rigidly fixed to the edge of the boards.

An important concept of the present invention concerns the use of a hinge as a coupling element. Through the use of a hinge, a single swiveling axis, which allows for easy and unproblematic alignment, is defined between adjacent boards. The hinge for the invention is disposed so that the swiveling axis extends into the region of the facing sides, or fronts, of the boards. The points of fastening of the hinge correspond with the state of the art and are the two edges of the board which extend perpendicular to the swiveling axis, whereby fastening is effected proximate to the swiveling axis region so that, as a consequence, the series of hinges form the corners of the assembled wall. In order to permit dismantling and eventual re-use of the wall, detachable fastening means must be provided. In contrast to the state of the art, the connection with the board, however, is a rigid one. Most frequently, however, the swiveling axis extends in a vertical direction.

The advantages achievable with the present invention are manifold. They include the fact that, because of the use of a hinge, subsequent infinite swivel adjustments are possible whereby, due to the lack of a further rotational axis, exact adjustment can be carried out without difficulty. With the corresponding selection of fastening means, a rapid erection and dismantling of the wall is possible without special manual skills and without tools.

Within the framework of the invention, it is, in principle, open as to which types of fastening means are used in for the rigid, but detachable, localization of the hinge on the edge of the board.

With regard to the object of the fastest possible assembly and dismantling of the walls, which are principally used for trade fair and exhibition construction, the utilization of a plug-in connection is preferred, whereby each leg of the hinge is provided with pegs which are inserted into the edge of the board. In the case of a vertical swiveling axis and boards arranged one above another, the plugs will be aligned vertically, both upwards as well as downwards. During assembly, the plugs are inserted into the openings of the board provided therefor, and during dismantling are pulled out.

To clarify, compared with the state of the art, attention is drawn to the fact that the peg, as a rigid means of fastening, serves only the spatial fixation, and not the production of rotational movement permitting a relative swiveling about the peg.

A detachable fastening of the peg within the hinge is preferred, so as to achieve in the edge regions of the wall, through removal of the peg, a flat and level, smooth border shape and, if applicable, the possibility of the disposal of a cover or base strip.

In order to avoid an air gap between the individual boards, it is further proposed to provide the facing sides in the region of swiveling axes extending lengthways with a profile section, which has the shape of an isosceles triangle, the apex of which lies respectively more or less in the swiveling axis. Thus, it is guaranteed that in every angularity, the neighboring boards rest against one another in the region of the swiveling axis. The triangular profile section results in a restriction of the angular freedom of the boards. With a base angle of 45° of the isosceles triangle, the minimum angle between adjacent boards is then exactly 90°.

The edges of the boards can also be formed through the disposal of solid and hollow profiles, which may include one or more pieces.

In the case of a detachable fastening, the possibility exists for removal of the profile after prolonged use and to coat the board's surface with paint or with foil and/or textile materials for the purpose of restoring it. Furthermore, the possibility is created for the exchange of a smooth profile for a slotted profile (and vice versa.)

In a suitable and preferred embodiment of the present invention, it is proposed to dispose, between the adjacent facing sides of the boards which cannot be swiveled relative to one another—here more frequently this concerns facing surfaces extending horizontally—a spacer, the thickness of which corresponds to that of the leg of the hinge. The spacer guarantees a neat and straight alignment of the neighboring walls. The "U"-sections have drilled holes which are penetrated by the fastening means, in particular, the pegs of the hinge, so that engagement with adjacent boards is possible despite the use of the "U"-section. The "U"-section serves, on the one hand, to fix the leg of the hinge, as well as together with the hinge, to keep the neighboring boards at a distance.

If the receiver for the hinge or spacer is spring mounted, this guarantees that the hinge or spacer cannot fall off, in an uncontrolled manner, during dismantling.

The two legs of the hinge each have a tooth construction in the region of the swiveling axis, which is complementary in form and is interlocking. By these means, a high stability of the connection is achieved.

Of advantage is to produce the axis of the two legs by means of a socket with internal screw thread, so that the possibility is created, through the production of a screw connection, to provide an external means of fastening to the ceiling or floor, or to other framed constructions. Equally, the screw thread could be used to fasten a footing part or a lamp.

Furthermore, it is proposed in a further preferred embodiment of the present invention to provide in the profiles, which mostly extend in a vertical direction and are found in the edge region, slots for the reception of hooks. This measure allows the fastening of pictures, consoles, indicator boards, brochure holders and similar means of hooks without damaging the boards of the wall. The boards can be used immediately after one use for a new purpose without the need for repairs. Due to the distance between neighboring boards, a useful hook, also for fastening, of a more or less Z- or step-shape in the region of the board, can be hung in the spaces between the "U"-sections.

Finally, it is proposed in a further preferred embodiment to provide the wall on the floor side with a base and on the ceiling side with a cover strip. As with the profile extending in the edge region, in the case of a hollow formation, the base and cover strip can be used for the accommodation and guiding of supply cables, as well as for the reception of foot brackets.

Other objects and features of the present invention will be apparent when considered in connection with the accompanying drawing figures, which illustrate preferred embodiments of the present invention. It should be stressed, however, that the drawing figures are intended solely as a means for illustrating certain features and embodiments of the invention and are not intended as a means for defining the limits thereof.

BRIEF DESCRIPTION OF THE DRAWING FIGURES

In the drawing, wherein similar reference numerals denote similar features throughout the several views:

FIG. 1 is a perspective view of a section of a wall constructed according to the present invention; and, FIG. 2 is a further perspective view of the top end of a wall, constructed in accordance with the invention, with a cover strip.

DETAILED DESCRIPTION OF THE DRAWING FIGURES

Figure 1:
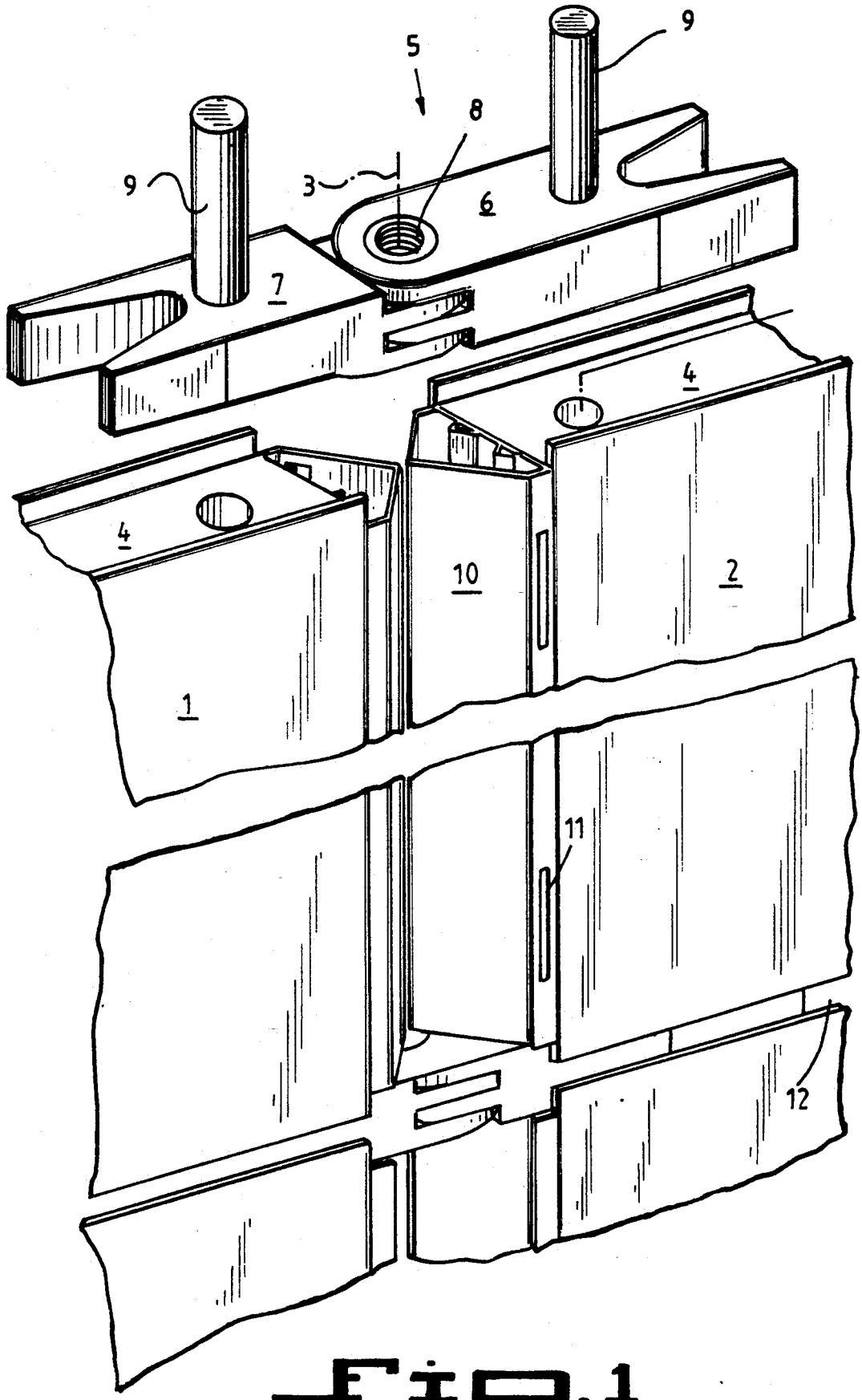

Turning now, in detail, to an analysis of the drawing figures, the figures illustrates, in the form of an exploded representation, two boards (1, 2) disposed next to each other and which are swiveled relative to one another about an axis which extends in a vertical direction. On the top edge (4), the boards (1, 2) are connected by means of a hinge (5). The hinge (5) is formed by a first leg (6) and a second, further, leg (7), which are connected to one another in a swiveling manner via a tooth system and with the aid of a socket (8) via an interior screw thread. The axis of the hinge (5) defines the swiveling axis of the boards (1, 2). Fastening of the hinge is achieved both at the top as well as at the bottom of pegs (9), which engage edgeways in the respective adjacent board. Erection and dismantling are especially easy because of the illustrated plug-in connection, i.e., without tools and special skills, and also rapidly executable.

The two boards (1, 2) are provided with hollow profiles (10) on their facing sides extending in a vertical direction, whose cross sections correspond more or less to that of an isosceles triangle, and which are connected to each other by their apexes, which as the same time define the swiveling axis (3). The profiles (10) are provided with slots (11), which serve the reception of hooks or other fastening elements.

Figure 2:
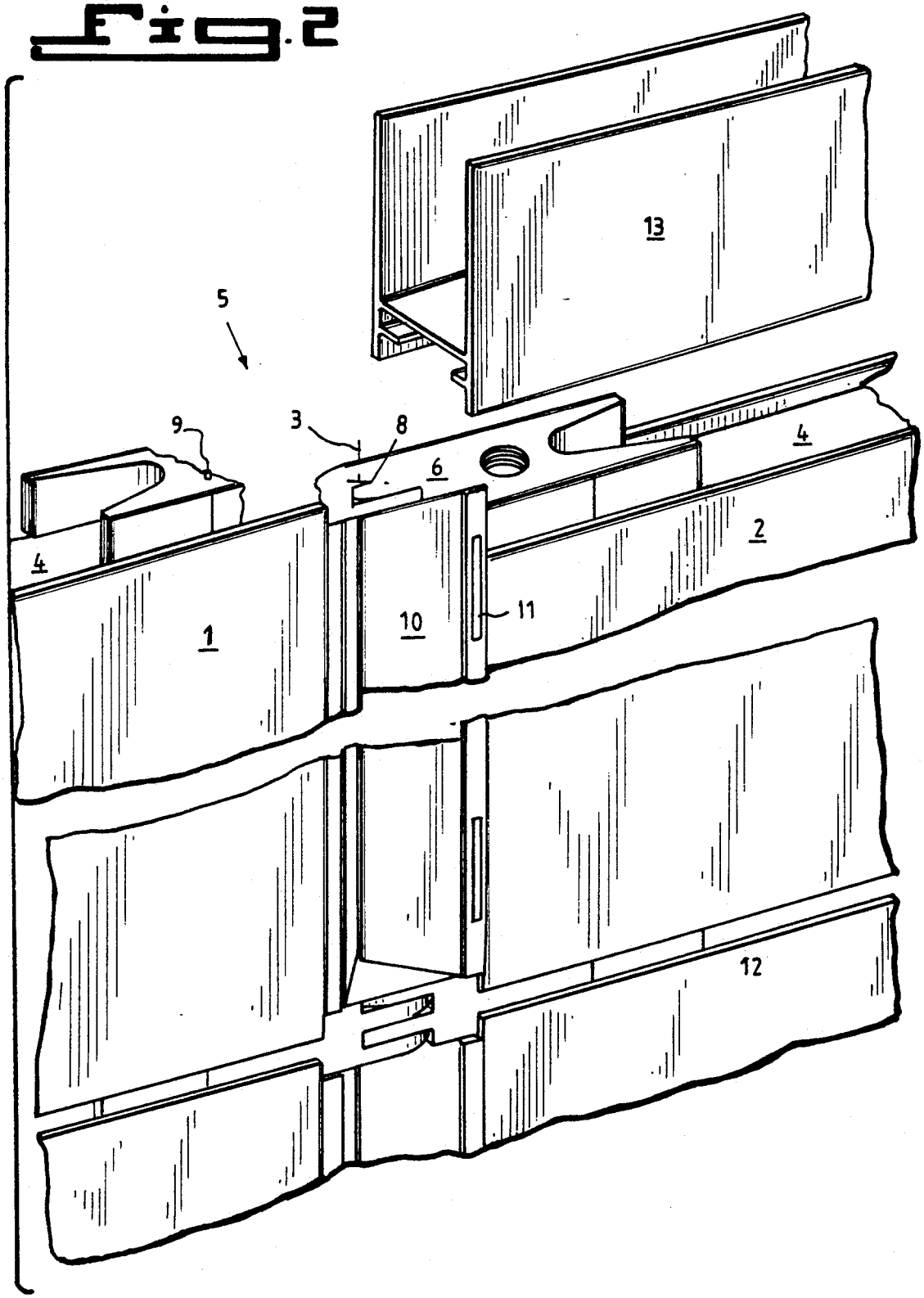

In FIG. 2, above the hinge (5), a cover strip (13) is indicated, which is shaped so that it surrounds and fixes the legs (6) of the hinge (5).

Between boards (1, 2) is disposed a spacer (12), which, however, does not extend the entire horizontal breadth of the joint, but leaves open a space, in which a hook can be hung.

As a result, a wall is obtained that is especially well suited for trade show and exhibition construction, which is rapidly erected and dismantled, and which, by means of a swiveling action, permits exact alignment.

While only several embodiments of the present invention have been shown and described, it will be obvious to those of ordinary skill in the art that many modifications may be made to the invention without departing from the spirit and scope thereof.

What is claimed is:

1. A wall capable of rapid assembly and dismantling, comprising:

a plurality of detachable boards, each of said plurality of detachable boards being connected to at least one other of said detachable boards on an adjacent facing side; and, coupling elements for connecting each of said plurality of detachable boards to another of said detachable boards, said coupling elements each permitting at least a part of the facing sides of said plurality of detachable boards, which extend in a vertical direction, a variable swiveling action about an axis extending parallel to the facing sides of said plurality of detachable boards, so that said coupling elements extend perpendicularly to a swiveling axis and in the direction of the swiveling axis and being fastened edgeways laying flat to each of two of said detachable boards being adjacent one another, said coupling elements acting as a spacing piece along the facing side of each of said detachable boards and extending perpendicular to the swiveling axis, with said facing side of each of said detachable boards being within an area of said swiveling axis and having a profile section lengthways in the form of an isosceles triangle, the apex of which lies substantially within said swiveling axis.

2. The wall capable of rapid assembly and dismantling according to claim 1, wherein said coupling elements are a plurality of hinges being attached to said detachable boards via fastening means, each of said plurality of hinges having two legs which are movable about an axis defining said swiveling axis of said detachable boards with said plurality of hinges being detachable via said fastening means, but which are otherwise rigidly fixed to an edge of each of two of said detachable boards.

3. The wall capable of rapid assembly and dismantling according to claim 2, further comprising a spacer disposed between adjacent facing sides of said detachable boards which cannot be swiveled relative to one another, the thicknesses of which correspond to at least one of said legs of said hinge.

4. The wall capable of rapid assembly and dismantling according to claim 2, wherein said hinge has two legs that are interlocked and meshed with one another.

5. The wall capable of rapid assembly and dismantling according to claim 2, wherein the connection of both legs of said hinge is achieved by means of a socket.

6. The wall capable of rapid assembly and dismantling according to claim 5, wherein said socket means includes an internal screw thread.

7. The wall capable of rapid assembly and dismantling according to claim 2, wherein each of said legs of each hinge includes plugs which are insertable into said detachable boards.

8. The wall capable of rapid assembly and dismantling according to claim 7, wherein said plugs are connected with said hinge in a detachable manner.

9. The wall capable of rapid assembly and dismantling according to claim 1, wherein said facing sides form an angle of 45° with said detachable boards.

10. The wall capable of rapid assembly and dismantling according to claim 1, wherein said detachable boards are provided with a profile on their facing sides.

11. The wall capable of rapid assembly and dismantling according to claim 10, wherein said profile is fastened to said detachable boards in a detachable manner.

12. The wall capable of rapid assembly and dismantling according to claim 1, wherein said profile extends into an edge region of one of said detachable boards and is provided with slots for the reception of hooks.

13. The wall capable of rapid assembly and dismantling according to claim 1, wherein said wall is closed at top by a cover and at bottom by a base strip.

14. The wall capable of rapid assembly and dismantling according to claim 13, wherein inside of said cover accommodation is made for supply cables.

15. The wall capable of rapid assembly and dismantling according to claim 13, wherein inside of said base strip accommodation is made for supply cables.

16. The wall capable of rapid assembly and dismantling according to claim 1, wherein inside of said profile an accommodation is made for supply cables.

17. A wall capable of rapid assembly and dismantling, comprising:

a plurality of detachable boards, each of said plurality of detachable boards being connected to at least one other of said detachable boards on an adjacent facing side;

coupling elements for connecting each of said plurality of detachable boards to another of said detachable boards, said coupling elements each permitting at least a part of the facing sides of said plurality of detachable boards, which extend in a vertical direction, a variable swiveling action about an axis extending parallel to the facing sides of said plurality of detachable boards, so that said coupling elements extend perpendicularly to a swiveling axis and in the direction of the swiveling axis and being fastened edgeways laying flat to each of two of said detachable boards being adjacent one another, said coupling elements acting as a spacing piece along the facing side of each of said detachable boards and extending perpendicular to the swiveling axis, said coupling elements being a plurality of hinges attached to said detachable boards via fastening means, each of said plurality of hinges having two legs which are movable about an axis defining said swiveling axis of said detachable boards with said plurality of hinges being detachable via said fastening means, but which are otherwise rigidly fixed to an edge of each of two of said detachable boards; and, a spacer being disposed between adjacent facing sides of said detachable boards which cannot be swiveled relative to one another, the thicknesses of which correspond to at least one of said legs of said hinge.

18. The wall capable of rapid assembly and dismantling according to claim 17, wherein said hinge has two legs that are interlocked and meshed with one another.

19. The wall capable of rapid assembly and dismantling according to claim 17, wherein the connection of both legs of said hinge is achieved by means of a socket.

* * * * *